US009170590B2

(12) United States Patent
Price et al.

(10) Patent No.: US 9,170,590 B2
(45) Date of Patent: Oct. 27, 2015

(54) METHOD AND APPARATUS FOR LOAD ADAPTIVE LDO BIAS AND COMPENSATION

(71) Applicant: QUALCOMM Incorporated, San Diego, CA (US)

(72) Inventors: Burt L. Price, Raleigh, NC (US); Dhaval R. Shah, Raleigh, NC (US); Yeshwant Nagaraj Kolla, Wake Forest, NC (US)

(73) Assignee: QUALCOMM Incorporated, San Diego, CA (US)

( * ) Notice: Subject to any disclaimer, the term of this patent is extended or adjusted under 35 U.S.C. 154(b) by 144 days.

(21) Appl. No.: 13/788,451

(22) Filed: Mar. 7, 2013

(65) Prior Publication Data

US 2014/0117958 A1 May 1, 2014

Related U.S. Application Data

(60) Provisional application No. 61/720,427, filed on Oct. 31, 2012.

(51) Int. Cl.
*G05F 1/00* (2006.01)
*G05F 1/46* (2006.01)
*G05F 1/575* (2006.01)

(52) U.S. Cl.
CPC ..... *G05F 1/468* (2013.01); *G05F 1/575* (2013.01)

(58) Field of Classification Search
USPC ..... 323/273, 274, 275, 276, 277, 278, 279, 323/280, 281, 282, 311, 312, 313, 314, 315, 323/316, 317; 327/538, 539, 540, 541, 542, 327/543
See application file for complete search history.

(56) References Cited

U.S. PATENT DOCUMENTS 4,656,647 A 4/1987 Hotine
5,696,465 A 12/1997 Ishizuka
5,982,226 A 11/1999 Rincon-Mora
(Continued)

FOREIGN PATENT DOCUMENTS

CN 102117089 A 7/2011
EP 1635239 A1 3/2006
(Continued)

OTHER PUBLICATIONS

Cristea I., et al., "Supply Concept in Input Powered Two Channel Switch", Semiconductor Conference (CAS), 2010 International, IEEE, Piscataway, NJ, USA, Oct. 11, 2010, pp. 469-472, XP031812172, ISBN: 978-14244-578-0.
(Continued)

*Primary Examiner* — Nguyen Tran
(74) *Attorney, Agent, or Firm* — Nicholas J. Pauley; Peter Michael Kamarchik; Paul Holdaway

(57) ABSTRACT

An adaptive low dropout (LDO) regulator includes a load-based bias controller that generates a bias control signal based on the output load current, and has a differential amplifier with a bias adjustment that receives the bias control signal and responds by adjusting a bias of a transistor within the adaptive LOD regulator. Optionally, the bias control signal is generated according to a hysteresis rule. Optionally, the adaptive LOD regulator includes an adaptive load-based compensation network having a zero, the zero having a location based, at least in part, one more of an adjustable resistance or capacitance value controlled by the load-based bias controller.

14 Claims, 6 Drawing Sheets

(56) References Cited

U.S. PATENT DOCUMENTS

| | | | | |
|---|---|---|---|---|
| 6,031,417 | A | 2/2000 | Bechman | |
| 6,046,577 | A | 4/2000 | Rincon-Mora et al. | |
| 6,184,744 | B1 | 2/2001 | Morishita | |
| 6,188,211 | B1 | 2/2001 | Rincon-Mora et al. | |
| 6,188,212 | B1 | 2/2001 | Larson et al. | |
| 6,246,221 | B1 | 6/2001 | Xi | |
| 6,333,623 | B1 | 12/2001 | Heisley et al. | |
| 6,373,233 | B2 | 4/2002 | Bakker et al. | |
| 6,518,737 | B1 | 2/2003 | Stanescu et al. | |
| 6,522,111 | B2 | 2/2003 | Zadeh et al. | |
| 6,617,833 | B1 | 9/2003 | Xi | |
| 6,703,815 | B2 | 3/2004 | Biagi | |
| 7,091,710 | B2 | 8/2006 | Yang et al. | |
| 7,142,022 | B2 | 11/2006 | Kang et al. | |
| 7,215,103 | B1 | 5/2007 | Wong et al. | |
| 7,224,156 | B2 | 5/2007 | Chen | |
| 7,339,416 | B2 | 3/2008 | Rincon-Mora et al. | |
| 7,612,547 | B2 | 11/2009 | Renous | |
| 7,728,569 | B1 | 6/2010 | Le et al. | |
| 7,768,351 | B2 | 8/2010 | Ivanov et al. | |
| 8,044,653 | B2 | 10/2011 | Maige et al. | |
| 8,072,196 | B1 | 12/2011 | Li | |
| 8,080,983 | B2 | 12/2011 | Lourens et al. | |
| 8,169,203 | B1 | 5/2012 | Vemula | |
| 8,242,761 | B2 | 8/2012 | Napravnik | |
| 2005/0231180 | A1* | 10/2005 | Nagata et al. | 323/268 |
| 2006/0055383 | A1 | 3/2006 | Eberlein | |
| 2006/0232327 | A1 | 10/2006 | Takagi et al. | |
| 2007/0191683 | A1 | 8/2007 | Fujimori | |
| 2008/0061881 | A1 | 3/2008 | Takagi | |
| 2008/0081947 | A1 | 4/2008 | Irion et al. | |
| 2008/0224680 | A1 | 9/2008 | Suzuki | |
| 2009/0066306 | A1 | 3/2009 | Noda | |
| 2009/0072984 | A1 | 3/2009 | Cheng et al. | |
| 2010/0013449 | A1 | 1/2010 | Miki | |
| 2010/0156364 | A1 | 6/2010 | Cho et al. | |
| 2011/0241769 | A1 | 10/2011 | Jung | |
| 2012/0161734 | A1 | 6/2012 | Wu | |
| 2012/0176107 | A1 | 7/2012 | Shrivas et al. | |
| 2012/0212199 | A1 | 8/2012 | Amer et al. | |
| 2012/0229202 | A1 | 9/2012 | Nikolov et al. | |
| 2014/0117956 | A1 | 5/2014 | Price et al. | |
| 2014/0125300 | A1 | 5/2014 | Price et al. | |
| 2014/0139197 | A1 | 5/2014 | Price et al. | |

FOREIGN PATENT DOCUMENTS

| | | | |
|---|---|---|---|
| EP | 2082680 | A1 | 7/2009 |
| JP | 2001137182 | A | 5/2001 |
| JP | 2005205072 | A | 8/2005 |
| JP | 2006230680 | A | 9/2006 |
| JP | 2007280025 | A | 10/2007 |
| KR | 20090028282 | A | 3/2009 |
| WO | 2012104673 | A1 | 8/2012 |

OTHER PUBLICATIONS

International Search Report and Written Opinion—PCT/US2013/067187—ISA/EPO—Mar. 6, 2014.

Kim Y.I., et al., "Fast Transient Capacitor-Less LDO Regulator Using Low-Power Output Voltage Detector", Electronics Letters, IEE Stevenage, vol. 48, No. 3, Feb. 2, 2012, pp. 175-177, XP006040603, ISSN: 0013-5194, DOI: 10.1049/EL.2011.

Liu X. et al., "Design of off-chip capacitor-free CMOS low-dropout voltage regulator", Circuits and Systems, 2008. APCCAS 2008. IEEE Asia Pacific Conference on, IEEE, Piscataway, NJ, USA, Nov. 30, 2008, pp. 1316-1319, XP031405243, DOI: 10.1109/APCCAS.2008.4746270 ISBN: 978-1-4244-2341-5.

Ying O.P., et al., "An Output-Capacities Low-Dropout Regulator with Direct Voltage-Spike Detection", IEEE Journal of Solid-State Circuits, Service Center, Piscataway, NJ, USA, vol. 45, No. 2, Feb. 1, 2010, pp. 458-466, XP011301260, ISSN: 0018-9200, DOI: 10.1109/JSSC.2009.2034805.

EP Search Report dated Jun. 18, 2013.

International Search Report and Written Opinion—PCT/US2013/068522—ISA/EPO—Jun. 30, 2014.

* cited by examiner

METHOD AND APPARATUS FOR LOAD ADAPTIVE LDO BIAS AND COMPENSATION

CLAIM OF PRIORITY UNDER 35 U.S.C. §119

The present application for patent claims priority to Provisional Application No. 61/720,427 entitled "METHOD AND APPARATUS FOR LOAD ADAPTIVE LDO BIAS AND COMPENSATION" filed Oct. 31, 2012, and assigned to the assignee hereof and hereby expressly incorporated by reference herein.

FIELD OF DISCLOSURE

The technical field of the disclosure relates to voltage regulators and, more particularly, to low dropout (LDO) regulators.

BACKGROUND

An LDO regulator is a direct current (DC) linear voltage regulator that can operate with a very low dropout, where "dropout" (also termed "dropout voltage") means the difference between the input voltage (e.g., received power supply rail voltage) and the regulated out voltage. As known in the conventional voltage regulator arts, low dropout voltage may provide, for example, higher efficiency and concomitant reduction in heat generation, and may provide for lower minimum operating voltage.

Two of the performance metrics for LDO regulators are the capability to avoid voltage drop, or "droop" in response to rapid load increase, and stability against oscillation. Conventional LDO regulators, though, are feedback devices. Therefore, as can be inherent in feedback devices, conventional design techniques directed to improving one of these two LDO regulator performance metrics may have opposite effects on the other. A completed conventional design of an LDO regulator may, therefore, reflect a compromise. One result of such conventional design compromise can be reduction in a maximum current capability, or current change, that the LDO regulator can handle while maintaining an acceptable droop. In addition, the compromise is embodied in fixed device parameters, for example fixed bias current and compensation components. However, operating conditions are not necessarily fixed. For example, LDO regulator output current may vary over a large range. One set of bias current or component values may be unable to provide optimal droop, or stability performance, or either, over the entirety of such a range.

SUMMARY

The following summary is not an extensive overview of all contemplated aspects. Its sole purpose is to present some concepts of one or more aspects in a simplified form as a prelude to the more detailed description that is presented later.

One example adaptive low dropout (LDO) regulator in accordance with one or more exemplary embodiments may include a pass gate having a control input, and configured to provide a variable resistance current path from an external power rail to a pass gate output, at a resistance based, at least in part, on a pass gate control signal received at the control input, in combination with a load-based bias controller circuit configured to generate a load-based bias control signal corresponding, at least in part, to a load current that is output from the pass gate output. One example, further to one or more exemplary embodiments may also include an adaptive bias differential amplifier having a first input coupled to the pass gate output, a second input, and a transistor having a gate coupled to one of the first input and the second input. In an aspect, the adaptive bias differential amplifier may be configured to receive the load-based bias control signal and to bias the transistor at a bias level that may be based, at least in part, on the load-based bias control signal. In a further aspect, the adaptive bias differential amplifier may be configured to generate the pass gate control signal based on voltages received on the first input and the second input, according to a loop bandwidth based, at least in part, on the bias level.

In an aspect, the adaptive bias differential amplifier may further include an adaptive tail current source configured to receive the load-based bias control signal and, in response, pass a bias current through the transistor that is based, at least in part, on the load-based bias control signal, to bias the transistor at said bias level.

In one example adaptive LDO regulator in accordance with one or more exemplary embodiments, load-based bias controller circuit may be further configured to generate a load-based compensation control signal based, at least in part, on the load current. In an aspect, the adaptive LDO regulator may further comprise an adaptive compensation network coupled between the pass gate output and the adaptive bias differential amplifier. The adaptive compensation network may, accordingly, provide at least one zero in a transfer characteristic and, in an aspect, adaptive compensation network may be configured to receive the load-based compensation control signal and, in response, to adjust a position of the at least one zero.

In one example adaptive LDO regulator in accordance with one or more exemplary embodiments, the load-based bias controller circuit may be configured to transition a present state between a first state and a second state according to a hysteresis rule, and may be configured to generate the load-based bias control signal at a first bias control level when in the first state and to generate the load-based bias control signal at a second bias control level when in the second state. In an aspect, the hysteresis rule may comprise: when the present state is the first state, to transition the present state to the second state in response to the load current exceeding a first threshold, and when the present state is the second state, to transition the present state to the first state in response to the load current falling below a second threshold and, further to this aspect, the second threshold may be less than the first threshold.

In one example adaptive LDO regulator in accordance with one or more alternative exemplary embodiments, the load-based bias controller circuit may includes a two-state current mirror configured to receive a hysteresis control signal having a light load state value and a heavy load state value, and to receive the pass gate control signal. In an aspect, the a two-state current mirror may be configured while the hysteresis control signal is at the light load state value, to pass a sense current at a first scalar multiple of the pass gate control signal, and while the hysteresis control signal is at the heavy load state value, to pass the sense current at a second scalar multiple of the pass gate control signal, wherein the second scalar multiple is greater than the first scalar multiple.

In an aspect, a current-to-voltage detector may be coupled to the two-state current mirror and may be configured to generate the hysteresis control signal, and the current-to-voltage detector may be configured to generate the hysteresis control signal at the light load state value in response to the sense current being less than a given sense current threshold and to generate the hysteresis control signal at the heavy load state value in response to the sense current being greater than the given sense current threshold.

In a further aspect, the load-based bias controller circuit may be configured to generate the load-based bias control signal based, at least in part, on the hysteresis control signal.

One or more exemplary embodiments provide methods for controlling a low dropout (LDO) regulator having a pass gate output and having a transistor-based differential amplifier that is configured to control a voltage-controlled pass gate to pass a load current from a power rail to the pass gate output, and examples of such methods can include generating a bias control signal indicative of a characteristic of the load current, and biasing the transistor-based differential amplifier at a level based, at least in part, on the bias control signal.

In an aspect, generating the bias control signal may include generating the bias control signal at a first bias control level in response to the load current exceeding a load threshold, and generating the bias control signal at a second bias control level in response to the load current not exceeding the load threshold.

In another aspect, generating the bias control signal may include setting a present generating state to one from among a first generating state and a second generating state, generating the bias control signal according to the present generating state until an occurrence of a transition event, wherein the transition event may be defined by a hysteresis transitioning rule and, upon the transition event, transitioning to a next generating state, making the next generating state the present generating state, and returning to the generating the bias control signal according to the present generating state.

In a related aspect, a hysteresis transitioning rule may include, for example, when the present generating state is the first generating state, the transition event being the load current exceeding a first threshold, and when the present generating state is the second generating state, the transition event being the load current not exceeding a second threshold, and in a further aspect the second threshold may be less than the first threshold.

One or more exemplary embodiments may provide an LDO regulator having a pass gate having a control input, and configured to provide a variable resistance current path from an external power rail to a pass gate output, at a resistance based, at least in part, on a pass gate control signal received at the control input, a differential amplifier having a first input coupled to the pass gate output, a second input, and a transistor having a gate coupled to one of the first input and the second input, wherein the bias differential amplifier is configured to generate the pass gate control signal based on voltages received on the first input and the second input, in combination with means for adapting a bias of the transistor according to a load current output from the pass gate output, and the differential amplifier may be configured to generate the pass gate control signal according to a loop bandwidth based, at least in part, on the bias of the transistor.

BRIEF DESCRIPTION OF THE DRAWINGS

The accompanying drawings found in the attachments are presented to aid in the description of embodiments of the invention and are provided solely for illustration of the embodiments and not limitation thereof.

DETAILED DESCRIPTION

Aspects of the invention are disclosed in the following description and related drawings directed to specific embodiments of the invention. Alternate embodiments may be devised without departing from the scope of the invention. Additionally, well-known elements of the invention will not be described in detail or will be omitted so as not to obscure the relevant details of the invention.

The word "exemplary" is used herein to mean "serving as an example, instance, or illustration." Any embodiment described herein as "exemplary" is not necessarily to be construed as preferred or advantageous over other embodiments. Likewise, the term "embodiments of the invention" does not require that all embodiments of the invention include the discussed feature, advantage or mode of operation.

The terminology used herein is only for the purpose of describing particular examples according to embodiments, and is not intended to be limiting of embodiments of the invention. As used herein, the singular forms "a", "an" and "the" are intended to include the plural forms as well, unless the context clearly indicates otherwise. As used herein the terms "comprises", "comprising,", "includes" and/or "including" specify the presence of stated structural and functional features, steps, operations, elements, and/or components, but do not preclude the presence or addition of one or more other structural and functional feature, steps, operations, elements, components, and/or groups thereof.

The phrases "persons skilled in the art" and "those of skill in the art" have identical meaning, which is "persons of ordinary skill in the art to which the embodiments pertain," and the phrases "a person skilled in the art" and "a person of skill in the art" have identical meaning, which is a "a person of ordinary skill in the art to which the embodiments pertain."

Those of skill in the art will appreciate that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields, electron spins particles, electrospins, or any combination thereof.

The term "topology" as used herein refers to interconnections of circuit components and, unless stated otherwise, indicates nothing of physical layout of the components or their physical locations relative to one another. Figures described or otherwise identified as showing a topology are no more than a graphical representation of the topology and do not necessarily describe anything regarding physical layout or relative locations of components.

Figure 1:
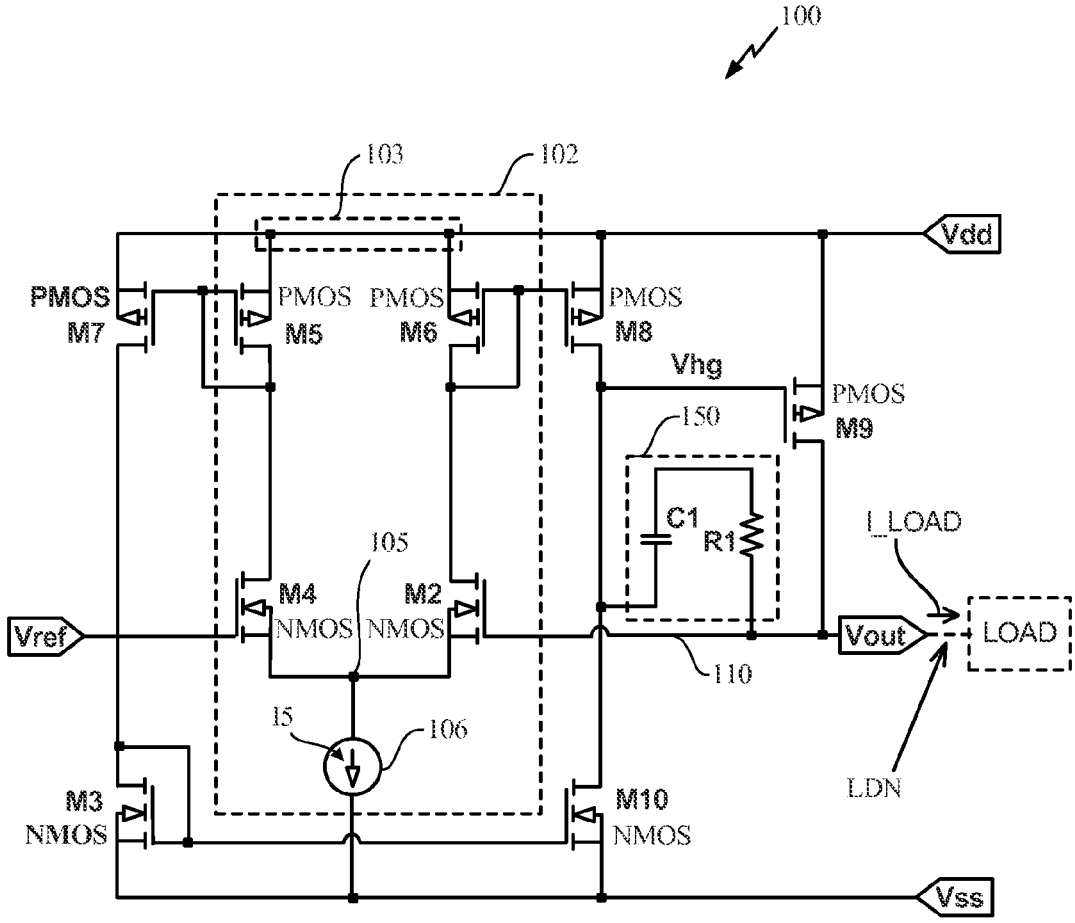
FIG. 1 shows a topology for one example LDO regulator unit.

FIG. 1 shows a topology for one LDO regulator 100, having a differential amplifier 102 and a voltage-controlled pass gate M9, which provides a variable resistance current path coupling an external power rail Vdd to a pass gate output, or regulator output Vout. In the FIG. 1 example, the pass gate M9 is a PMOS transistor having a pass gate input (shown but not separately numbered) coupled to the power rail Vdd, and pass gate output coupled to Vout. The differential amplifier 102 receives as its differential inputs a reference voltage, Vref, and a feedback of Vout (over feedback path 110). The differential amplifier 102 generates, based on the difference between Vref and the fed back Vout, a Vhg voltage that drives the resistance of pass gate M9 to a value at which Vout is, in this example, approximately equal to Vref. It will be understood that Vout being approximately equal to Vref is only for purposes of example. For example, a voltage divider (not shown) may be included to generate Vout higher than Vref.

The differential amplifier 102 may include, for example, two transistor-controlled branches (shown but not explicitly labeled), extending in parallel from a top common node 103 (which may be the Vdd rail) to a bottom common node 105. A fixed bias current source (alternatively referred to as "tail current source") 106, described in greater detail later, sinks a bias current I5 from the bottom common node 105 to a sink or reference rail, e.g., the Vss power or reference rail.

One of the two transistor-controlled branches can be formed by a series coupling of a first transistor M2, alternatively referenced as the "feedback-controlled input transistor" M2, and a first load or first current source transistor M6. In one example, a first electrode (shown but not separately labeled) of M2 may couple to the bottom common node 105, and a second electrode (shown but not separately labeled) of M2 may couple, through M6, to the top common node 103. The gate (shown but not separately labeled) of M2 may couple to, or be integral with a first input (shown but not separately labeled) of the differential amplifier 102.

The other of the two transistor-controlled branches may be formed by a series coupling of a second transistor M4, alternatively referenced as the "reference-controlled input transistor" M4 and a second load or second current source transistor M5. In one example coupling, a first electrode (shown but not separately labeled) of M4 may couple to the bottom common node 105, and a second electrode (shown but not separately labeled) of M4 may couple through M5 to the top common node 103. The gate (shown but not separately labeled) of M4 may couple to, or be integral with a second input (shown but not separately labeled) of the differential amplifier 102.

For brevity in describing example operations, the reference input transistor M4 and the feedback input transistor are hereinafter alternatively referenced, collectively, as "input transistors M2 and M4."

Transistors M3, M7, M8 and M10 form an intermediate buffer stage (shown but not separately numbered. The drain of M8 couples a pass gate control signal, or pass gate control voltage Vhg to the control input (shown but not separately numbered) of the output pass gate M9.

As previously described, the tail current source 106 sinks a bias current I5 from the bottom common node 105, and the magnitude of I5 sets the bias of the input transistors M2 and M4. The bias of the input transistors M2 and M4 affects the bandwidth and slew rate of the LDO regulator 100. The tail current source 106 is fixed, though, so the value of I5 is selected (e.g. the tail current source is fabricated) to bias the input transistors M2 and M4 at a value that may be based on optimal point with respect to bandwidth and slew rate. However, the value of I5 may have other effects; for example, a higher I5 can increase power loss. Accordingly, in various applications, selection of the value of I5 may embody compromises among, and of multiple performance goals of the LDO regulator 100.

Referring to FIG. 1, the LDO regulator 100 may include a compensation network 150 coupled to the Vout output of the pass transistor M9. The compensation network 150 may provide at least one "zero" in the loop characteristic of the LDO regulator 100, at position(s) set, at least in part, by resistance values of certain of its resistors and capacitance values of certain of its capacitors. A function of such zeros is compensation, at least in part, for one or more "poles" in the loop characteristic that may be inherent to the structure of the LDO regulator 100 in view of parasitic capacitance on the load line LDN, or a dominant pole (or poles) from intentionally placed load capacitors (not shown in FIG. 1). Such dominant poles may provide the LDO regulator 100 with a certain improvement in capability for handling rapid increases in I_LOAD. On the other hand, if not compensated, the described poles, both the dominant type and the lesser type arising from parasitics, can cause or create potential instabilities in the LDO regulator 100, at least in certain operating conditions. The function of the compensation network 150, as previously described, is the providing of such compensation. The location one or more zeros to which the described resistance and capacitance values are targeted is determined by the location of the poles to be compensated.

However, various complications may arise, for example, in selecting the positions of the zeros. One such complication is that the position of the poles may vary with respect to I_LOAD. Another complication, which may arise in particular when compensating against instabilities from intentionally placed poles, is that the compensation may operate counter to the improvement (e.g., certain transient response) for which the pole was selected. Accordingly, in various applications, selection of the target positions of the zeros, and therefore the values of components within the compensation network that set such positions, may embody compromises between, for example, transient response and stability of the LDO regulator 100.

Figure 2:
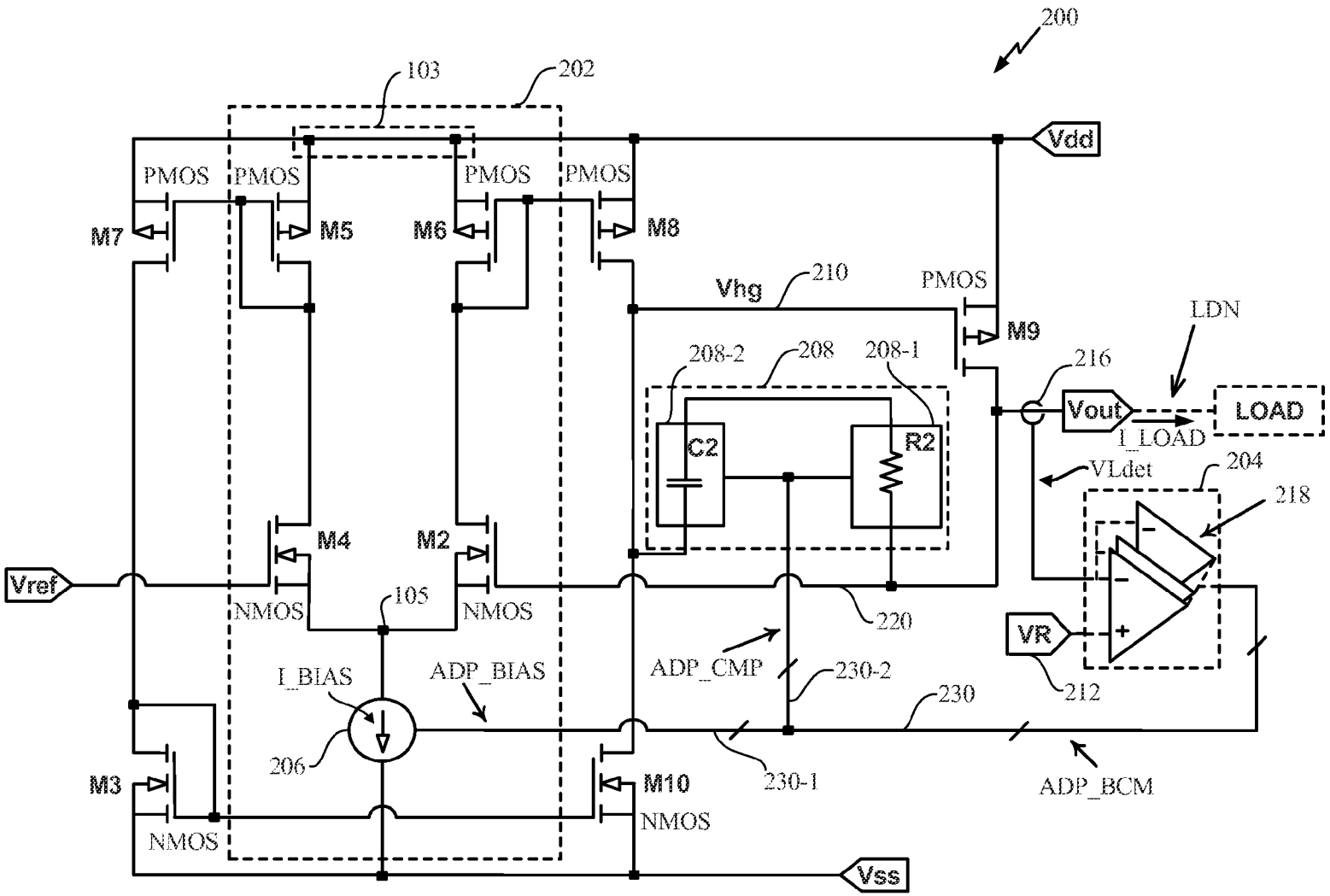
FIG. 2 shows one example topology of one adaptive bias and compensation LDO regulator in accordance with one exemplary embodiment.

FIG. 2 shows one example topology of one adaptive bias and compensation LDO regulator 200 in accordance with one or more exemplary embodiments. The adaptive bias and compensation LDO regulator 200 has an adaptive bias differential amplifier 202, and a load-based bias controller 204, alternatively referred to as the "load-based bias controller circuit" or "load-based bias controller" 204, and described in greater detail at later sections of this disclosure. The adaptive bias differential amplifier 202 is formed, for purposes of illustration, as a transistor-based differential amplifier using certain structure of the FIG. 1 differential amplifier 102, replacing the fixed bias current source 106 with an adaptive tail current source 206. The adaptive tail current source 206 can be configured to generate a bias current I_BIAS at a bias current level that is controlled by the load-based bias controller 204. As will be appreciated by persons of ordinary skill having possession of the present disclosure, in operation the FIG. 1 fixed bias current source 106 fixes at I5 the sum of a first bias current flowing through the first transistor M2 and a second bias current flowing through the second transistor M4. Referring to FIG. 2, under control of the load-based bias controller 204 the adaptive tail current source 206 can, in contrast, adjust the bias level by adjusting the I_BIAS, i.e., the sum of the first bias current and the second bias current.

The load-based bias controller 204 may be configured, in accordance with exemplary embodiments, to control the adaptive tail current source 206 by a load-based bias control signal ADP_BIAS, generated based on one or more characteristics of the load current I_LOAD. In a further aspect, the load-based bias controller 204 can generate ADP_BIAS to place transistors within the adaptive bias differential amplifier 202 at a bias level, i.e., an operating point dynamically adapted to the one or more characteristics of I_LOAD.

The load-based bias controller 204 may be configured to generate ADP_BIAS based on a present magnitude of I_LOAD. It will be understood that this is only one example of "based on" on I_LOAD and is not intended to limit the scope of practices contemplated by the exemplary embodiments. For example, as described in greater detail at later sections, generation of ADP_BIAS in accordance with one or more exemplary embodiments encompasses generation based on a present state of the load-based bias controller 204 and a transition event, e.g., a detected I_LOAD event that is defined, at least in part, according to the present state.

In another aspect, the adaptive bias and compensation LDO regulator 200 further includes, in accordance with one or more exemplary embodiments, an adaptive compensation network 208 coupled between the feedback path 220 and, for example, the pass gate control line 210. In a further aspect, the adaptive compensation network 208 may include variable, controllable elements, e.g., at least one voltage-controlled resistance element 208-1 and/or at least one variable capacitance element such as 208-2, also controlled based on I_LOAD. Control of the variable elements may be provided by a load-based compensation control signal, for example, ADP_CMP that may be generated by the load-based bias controller 204 based on I_LOAD. In an aspect, adaptive compensation network 208 responds to the ADP_CMP signals by varying one or more of its variable components, e.g., the variable resistance element 208-1, to adapt its transfer characteristic, e.g., a position of at least one zero, in accordance with I_LOAD. In one aspect, the load-based bias controller 204 may be configured to adjust or adapt the biasing of adaptive differential amplifier 202 using an I_LOAD verses bias level characteristic different from than used to adjust or adapt the adaptive compensation network 208.

The FIG. 2 example load-based bias controller 204 has an associated load current detector circuit 216 that, corresponding to I_LOAD, generates a load current detection signal, or sense voltage, arbitrarily labeled "VLdet." It will be understood that the load current detector circuit 216 is shown separate from the load-based bias controller 204 only for purposes of showing functions. The load current detector circuit 216 may be included in, or separate from the load-based bias controller 204. In an aspect, the load-based bias controller 204 may be configured to generate ADP_BIAS and ADP_CMP as stepped values, meaning multi-stepped values. Generation of ADP_BIAS and ADP_CMP as multi-stepped values may be implemented by, for example, comparing VLdet against at least one comparator, such as the representative plurality of example comparators 218. The number of steps comprising "multi-stepped" may be set by the number of comparators 218.

It will be understood that the example load-based bias controller 204 is not intended to limit the scope of any exemplary embodiments. Embodiments contemplate generating ADP_BIAS and ADP_CMP based on I_LOAD according to any given mapping, for example, any mapping that can be represented as:

$$ADP_BIAS = f(I_LOAD) \quad \text{Eq. (1)}$$

$$ADP_CMP = g(I_LOAD) \quad \text{Eq. (2)}$$

It will be understood that $f$ and g in Equations (1) are not intended to limit for g to being closed-form functions; one or both can be any mapping.

Referring to FIG. 2, the load-based bias controller 204 may, as previously described, employ a plurality of comparators 218 for a multi-stepped ADP_BIAS and/or ADP_CMP, and number of the comparators 218 may set the number of steps. For example, a single comparator 218 may provide ADP_BIAS as a two-stepped value. In such an example, ADP_BIAS may be a "light load bias control level" for "light load" conditions of I_LOAD below a load threshold, which may be a given value, and at a "heavy load bias control level" for "heavy load" conditions, i.e., high I_LOAD, above the given load threshold. One given load threshold will be arbitrarily labeled "THLD." One "light load bias control level" will be arbitrarily labeled "Level_1," and one "heavy load bias control level" arbitrarily labeled "Level_1." Using this example labeling, generation of ADP_BIA may be defined, or represented as:

$$ADP_BIAS = \begin{cases} Level_1, & I_LOAD \le THLD \\ Level_2, & I_LOAD > THLD, \end{cases} \quad \text{Eq. (3)}$$

"Level_1" and "Level_2" may be alternatively referenced as a "first bias control level" and a "second bias control level," respectively. It will be understood that the form of Equation (3) is only an approximation of a two-stepped value of ADP_BIAS, which is just one generation of bias currents in practices according to the exemplary embodiments. Actual implementations of a two-stepped generation may generate ADP_BIAS in a manner that deviates from Eq. (3). For example, actual implementations of the comparators 218 may exhibit breakpoints that may vary from "THLD," as well as deviating from the nominal relations of "less than or equal to" and "greater than" appearing in Equation (3).

It will be understood if ADP_BIAS is chosen as a discrete stepped generation the number of steps is not limited to two. On the contrary, two comparators 218 may be used, such that ADP_BIAS may be a mapping or function $f$(I_LOAD) with $f$ being a multi-step value, e.g., a three-step function such as $$ADP_BIAS = \begin{cases} Level_A, & \text{for } I_LOAD \le THLD_1 \\ Level_B, & \text{for } THLD_1 < I_LOAD \le THLD_2 \\ Level_C, & \text{for } I_LOAD > THLD_2 \end{cases} \quad \text{Eq. (4)}$$

or an equivalent form such as the following Equation (3A):

$$ADP_BIAS = \begin{cases} Level_A, & \text{for } I_LOAD < THLD_1 \\ Level_B, & \text{for } THLD_1 \le I_LOAD < THLD_2 \\ Level_C, & \text{for } I_LOAD \ge THLD_2 \end{cases} \quad \text{Eq. (4A)}$$

The values "THLD_1" and "THLD_2" are one example of, and can be referenced as a "first current threshold" and a "second current threshold," respectively. The bias levels "Level_A" and "Level_B" can be another example of a "first bias control level" and a "second bias control level," respectively. "Level_C" can be one example of, and can be referenced alternatively as a "third bias control level." Regarding the arrangement of the comparators 218, representative examples are shown with a "−" input and a "+" input (collectively "+/−" inputs). One of the +/− inputs may be coupled to an input (shown but not separately numbered) of the load-based bias controller 204, to receive an I_LOAD detection signal, for example VLdet from the load current detector circuit 216. The other of the +/− inputs may be coupled to a reference such as the threshold voltage reference 212.

It will be understood that if more than one comparator 218 is used, e.g., two or more comparators 218 for ADP_BIAS and one or more comparators for ADP_CMP, the threshold voltage reference 212 may be configured to provide a different reference voltage (not separately shown) to each of the different comparators 218. Alternatively, the threshold voltage reference 212 may be configured to generate a single reference voltage, e.g., Vref, and the load-based bias controller 204 may be configured with circuitry (not shown) to generate different reference voltages for the different comparators 218.

With respect to specific technologies for the comparators 218 and the threshold voltage reference 212, each of these may be application-specific and each may be, at least in part, design choice. However, selection and implementation of the comparators 218 and the threshold voltage reference 212 may be readily performed by persons of ordinary skill, by applying conventional techniques known to such persons to the present disclosure, without undue experimentation. Further detailed description of such selection and implementation is therefore omitted.

With respect to specific means and technologies for the load current detector circuit 216 for generating VLdet, exemplary embodiments are not limited to any particular one of such means or technologies. For example, the load current detector circuit 216 may measure I_LOAD directly, e.g., as a direct current-to-voltage conversion (not explicitly shown in FIG. 2) of I_LOAD. Persons skilled in art, having view of the present disclosure, can select and implement one or more means for such a direct current-to-voltage conversion, applying conventional current-to-voltage techniques known to such persons, without undue experimentation. Further detailed description is therefore omitted. There may be applications, in which direct current-to-voltage conversion on I_LOAD may be not preferred. For example, the load current detector circuit 216 may be a scaled mirror current source (not explicitly shown in FIG. 2) that may be coupled (not explicitly shown in FIG. 2) to Vhg, and configured to generate, in response, a scaled mirror of I_LOAD. Further to such an implementation, a current-to-voltage detector (not explicitly shown in FIG. 2) may be provided with the scaled mirror current source. One example configuration for such a circuit, and its generation of an equivalent to VLdet, is described in greater detail in reference to FIG. 3.

Means for communicating the generated ADP_BIAS and ADP_COMP from the load-based bias controller 204 to the adaptive bias differential amplifier 202 (e.g., to the adaptive current source 206), and to the adaptive compensation network 208, respectively, may include a bias/compensation control line 230. In one aspect, the bias/compensation control line 230 may branch to a bias control line 230-1 coupled to the adaptive bias differential amplifier 202, and to a compensation control line 230-2 coupled to the adaptive compensation network 208. It will be understood that the term "line" in the label "bias/compensation control line" 230 encompasses "bus" and "channel." It will be understood that "branch," in the context of the "bias/compensation control line (or bus)" 230 does not necessarily require a physical branching. For example, embodiments contemplate the bias/compensation control line 230 being a common, or shared bus connecting the load-based bias controller 204 to the adaptive bias differential amplifier 202 and to the adaptive compensation network 208. It will be understood that the bias/compensation control line 230 may be, for example, a parallel N-bit bus or line, having one or more of its N bits allocated for ADP_BIAS, and one or more allocated for ADP_CMP. In another example alternative, the bias/compensation control line 230 may be configured as a serial stream, employing, for example, any known conventional technique for multiplexing serial bits. In another example alternative, the bias/compensation control line 230 may be configured to carry one or both of ADP_BIAS and ADP_CMP as an analog signal at a continuously variable level, at a given mapping to a continuously variable load current I_LOAD.

In an example configuration, the load-based bias controller 204 may have one comparator 218 for ADP_BIAS, and may have a threshold voltage reference 212 and a load current detector circuit 216. The load current detector circuit 216 may be configured to generate VLdet as a particular function or mapping of I_LOAD, such that I_LOAD equals a threshold, e.g., THLD, when VLdet is at a given load detection threshold. Likewise, the threshold voltage reference 212 and one comparator 218 can be configured such that when I_LOAD falls below THLD, VLdet falls below the load detection threshold, causing ADP_BIAS to change from Level_2 (e.g., a high load) to Level_1 (e.g., a light load). In response to this change in ADP_BIAS, the adaptive tail current source 206 may increase I_BIAS from a heavy load bias current to a light load bias current. The light load bias current biases the input transistors M2 and M4 at an operating point, i.e., a light load bias level, at which the loop bandwidth is higher than the loop bandwidth exhibited when biased, by the heavy load bias current, at a heavy load bias level. This described stepped-value in ADP_BIAS, provided by the FIG. 2 load-based bias controller 204 configured with one comparator, may provide, among other features, substantial avoidance of an unwanted characteristic that may manifest in conventional LDO regulators, such as the FIG. 1 LDO regulator 100, of reduced loop bandwidth at light load current. The reduced loop bandwidth at light load current can be unwanted, as it can cause a degradation of droop performance in the event of a high-speed ramp-up of load current.

In the above-described example, when I_LOAD increases to a level exceeding THLD the comparator 218 switches again, such that ADP_BIAS changes from Level_1 (light load) back to Level_2 (heavy load). The adaptive tail current source 206 may, in response, switch OFF, or reduce I_BIAS to a lower default value, i.e., to the heavy load bias current. It will be understood that, in an aspect, provision for such switching OFF or reduction of I_BIAS may include the adaptive tail current source 206 being formed of two or more individually switchable (not explicitly shown) tail current sources in parallel. For example, the adaptive tail current source 206 may be formed of a nominal (not shown) tail current source and an "extra" or supplemental tail current source (not shown) that is selectively activated, by ADP_BIAS, for example in response to detecting light load conditions. Such switching OFF or reduction of I_BIAS may, in turn, drive the input transistors M2 and M4 to an operating point, e.g., to the heavy load bias level, at which the loop bandwidth is lower and therefore provide for better power efficiency.

The above-described examples of changing ADP_BIAS between Level_1 and Level_2 are an implementation of a mapping according to Equation (2), in which the light load bias level and the heavy load bias level can be characterized as a first bias level and a second bias level. One alternative embodiment can be a three-level load-based biasing, i.e., an implementation according to Equation (4) or (4A).

Referring to FIG. 2, as described previously, the adaptive bias and compensation LDO regulator 200 may include the adaptive compensation network 208 configured to receive load-based compensation controls signals ADP_CMP. In one aspect, the adaptive compensation network 208 may be configured with variable or adjustable elements, for example, one or more variable resistance elements 208-1 and/or one or more variable capacitance elements 208-2 controlled by ADP_CMP. In an aspect, the respective resistance value(s) of the one or more variable resistance elements 208-1, and/or the respective capacitance value(s) of the one or more variable capacitance elements 208-2 may set, at least in part, position of at least one compensating zero. By receiving the ADP_CMP values, one or more of these resistances and capacitances can be dynamically updated based, for example, on I_LOAD. As previously described, such dynamic updating in accordance with one or more exemplary embodiments may avoid, mitigate, or reduce one or more complications that may arise in selecting the positions of compensating zeros in the FIG. 1 compensation network 150. Such complication may include, for example, and without limitation, the position of the poles varying with respect to I_LOAD. The FIG. 2 example adaptive compensation network 208 can remove this and other complications, and can further enable a robust compensation that adapts to I_LOAD conditions. This in turn can provide benefits such as, with limitation, a significantly improved transient response, and stability.

With respect to technology for the variable resistance elements 208-1 and variable capacitor elements 208-2, these may be implemented by, for example, adapting known conventional voltage controlled resistor techniques, and known conventional voltage controlled capacitor techniques to the present disclosure. Further detailed description is therefore omitted.

The FIG. 2 load-based bias controller 204 has been described as generating ADP_BIAS and ADP_CMP as multi-stepped values, but without hysteresis in the I_LOAD thresholds. For example, in the above-describe operation with the load-based bias controller configured to transition in accordance with Equations (3) or (3A), the same THLD is used to transition from the light load state to a heavy load state, as for returning from the heavy load state back to the light load state. In certain applications, though, a given hysteresis rule may be desired.

Figure 3:
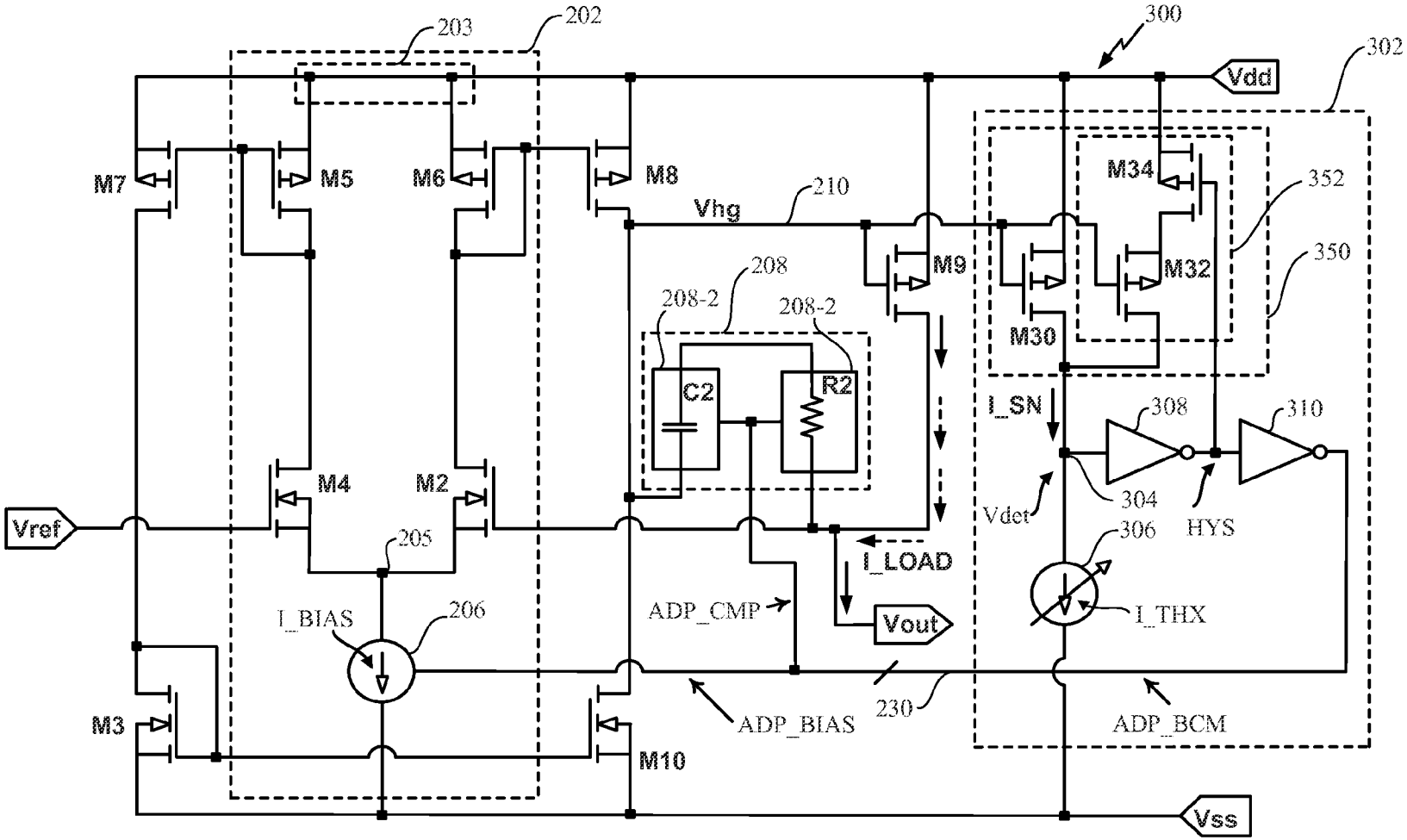
FIG. 3 shows one example topology employing the FIG. 2 example adaptive bias and compensation LDO regulator with one example load-based bias controller further to a hysteresis aspect in accordance with one exemplary embodiment.

FIG. 3 shows a topology of one adaptive bias and compensation LDO regulator 300 providing an aspect of hysteresis in generating ADP_BIAS and/or ADP_COM in accordance with various exemplary embodiments. To avoid complication of introducing new structure not necessarily particular to concepts, the FIG. 3 adaptive bias and compensation of LDO regulator 300 is shown as a modification of the FIG. 2 adaptive bias and compensation LDO regulator 200. Further to an aspect, the modification may include substituting a hysteresis controller, for example the hysteresis load threshold bias controller 302 for the load-based bias controller 204. It will be understood, however, that this example adaptive bias and compensation LDO regulator 300 is not intended to limit the scope of embodiments having the hysteresis feature to using the FIG. 2 topology adaptive bias and compensation LDO regulator 200.

For brevity, "hysteresis load threshold bias controller" 302 will be alternatively referred to as "HLT bias controller" 302. It will be understood that "HLT" has no intended additional meaning; it is simply an abbreviation for "hysteresis load threshold." To avoid obfuscation of concepts, detailed description of the generation of the adaptive bias and compensation LDO regulator 300 and its HLT bias controller 302 will generally reference ADP_BIAS. Structure and operations specifically performed for generating ADP_CMP are generally omitted. It will understood, though, that the HLT bias controller 302 may be configured for generating ADP_CMP with structure and operation substantially identical to that described for generating ADP_BIAS. Likewise, as will appreciated by persons skilled in the art upon reading this disclosure, generation of ADP_BIAS and ADP_CMP may be provided, for example, using two (not explicitly shown) HLT bias controllers 302, configured to generate each with its own hysteresis rules.

According to various exemplary embodiments, the HLT bias controller 302 can be configured to have a first state, for example a light load state, and a second state, for example a heavy load state. The HLT bias controller 302 can be configured to generate the ADP_BIAS, the above-described load-based bias control signal, at a first bias control level, e.g., Level__1, when in the first state and to generate ADP_BIAS at a second bias control level, e.g., Level__2, when in the second state. In an aspect, the HLT bias controller 302 can be configured to transition back and forth between the first state and the second state according to a given hysteresis rule, examples of which are described in greater detail below In one example according to one or more aspects, the HLT bias controller 302 may be configured with a two-state current mirror 350 having a current output (shown but not separately numbered) coupled to a sense node 304, and a threshold current source 306 coupling the sense node 304 to a reference rail, e.g., Vss. In an aspect, the threshold current source 306 can be configured to pass a current, termed hereinafter a "sense current" or I_SN, from the sense node 304 to the reference rail Vss at a low resistance if I_SN is less than a given sense current threshold, labeled I_THX, but transitions rapidly to a high resistance when I_SN reaches I_THX. The threshold current source 306 can be configured such that the resistance to an I_SN less than I_THX produces a sense voltage Vdet on the sense node 304 less than a given voltage threshold VTH, but rapidly increases above VTH upon I_SN current exceeding I_THX.

Referring to FIG. 3, the two-state current mirror 350 can be configured to be switchable between a first current mirror state and a second current mirror state in response to a hysteresis control signal HYS. Generation of HYS is described in greater detail at later sections.

In one aspect, subject to the limit of I_THX imposed by the threshold current source 306, the two-state current mirror 350 can be configured to pass I_SN to the sense node 304, when in its first current mirror state, as a first scalar multiple of the pass gate control signal Vhg. It will be understood that "scalar multiple" can be less than unity. For purposes of illustration, one example value of the first scalar multiple can be one-eighth. Since Vhg is proportional to I_LOAD, I_SN is proportional to (e.g., one eighth of) I_LOAD according to the first scalar multiple while the two-state current mirror 350 is in the first current mirror state, provided I_SN is less than I_THX. In a related aspect, still subject to I_THX, the two-state current mirror 350 can be configured to pass I_SN to the sense node 304, when in its second current mirror state, as a second scalar multiple of the pass gate control signal Vhg, with the second scalar multiple being greater than the first scalar multiple. For purposes of illustration, one example second scalar multiple can be one-fourth. In other words, according to this example (and assuming I_SN is less than I_THX), the two-state current mirror 350 in its second current mirror state passes to the sense node 304, in accordance with Vhg, a magnitude of I_SN that is twice the magnitude of I_SN that it passes in the first current mirror state.

As will be understood, the second scalar multiple being greater than the first scalar multiple can provide a transitioning of ADP_BIAS from a light load bias level to a heavy load bias level when I_LOAD exceeds a first threshold, but requires I_LOAD to fall to a second threshold that is less than the first threshold to transition ADP_BIAS back to the light load bias level. As an illustration, the second scalar multiple will be assumed as twice the first scalar multiple, and an assumed first threshold will be THLD. The ADP_BIAS levels will be assumed to be the previously described Level_1 and Level_2. Under these assumptions, the ADP_BIAS transitions from Level_1 to Level_2 when I_LOAD exceeds THLD but, in accordance with a hysteresis, requires I_LOAD to fall to one-half of THLD for ADP_BIAS to transition from Level_2 back to Level_1.

In overview, the HLT bias controller 302 may generate ADP_BIAS (and/or ADP_CMP, as described above) to transition the adaptive bias and compensation of LDO regulator 300 between multiple states, using transition rules that may depend in, in part, on its present state. One example configuration of the HLT bias controller 302 is described as having a first state and a second state in generating ADP_BIAS. In an aspect, the HLT bias controller 302 has a first I_LOAD threshold or transition event for switching from the first state to the second state and a second I_LOAD threshold or transition event for switching from the second state to the first state. In accordance with a hysteresis function, the first I_LOAD threshold may be higher than the second I_LOAD threshold. One example first state can be a "light load state" and a corresponding second state can be a "heavy load state." As to specific values defining "light load" and "heavy load" in the context of the FIG. 3 HLT bias controller 302, these are respective current ranges for which numerical values, as readily understood by persons of ordinary skill when reading this disclosure, are application-specific.

For purposes of description, the I_LOAD transition event or threshold causing switching of the HLT bias controller 302 from the light load state to the heavy load state will be referred to as a first threshold, or "I_TH1." One example I_TH1 may be the previously described THLD. The I_LOAD threshold or transition event causing switching from the heavy load state to the light load state will be referred to as a second threshold, or "I_TH2." In accordance with a hysteresis feature, I_TH2 may be lower than I_TH1. As illustration, the HLT bias controller 302 may be configured such that I_TH2 is ½ I_TH1. As will be appreciated by persons of skill in the art having view of the present disclosure, setting I_TH2 at, for example. ½ I_TH1 may provide various advantages and benefits, for example, repeated switching between the light load state and heavy load state due to I_LOAD oscillating at one of the thresholds.

As previously described, the HLT bias controller 302 may include a two-state current mirror 350. In one example implementation of the two-state current mirror 350 may include a current mirror transistor M30 having its gate (shown but not separately numbered) coupled to the pass gate control line 210 to receive the pass gate control voltage Vhg. In one aspect, described in greater detail at later sections, the current mirror transistor M30 may be a PMOS scaled copy of the PMOS pass gate M9. The current mirror transistor M30 will therefore be referred to, alternatively, as the "scaled mirror transistor" M30. The source (shown but not separately numbered) of the scaled mirror transistor M30 may be coupled to the Vdd power rail. The drain (shown but not separately numbered) of the scaled mirror transistor M30 may be coupled to a sense node 304.

A switched current mirror device 352 comprising another current mirror transistor M32 in series with a switch transistor M34 provides a parallel path from Vdd to the sense node 304. The current mirror transistor M32 will be alternatively referenced as the "switched current mirror transistor" M32. The switched current mirror transistor M32 has a gate (shown but separately numbered) coupled, like the gate of the scaled mirror transistor M30, to the pass gate control line 210, and drain (shown but not separately numbered) coupled to the sense node 304. The switched current mirror device 352 differs from the current mirror transistor M30 because the source (shown but not separately numbered) of the switched current mirror transistor M32 is switchably coupled to the Vdd rail, by the switch transistor M34, instead of being directly coupled like the current mirror transistor M32. The switch transistor M34 may be controlled by a hysteresis control signal HYS, generated as described in greater detail later, to switch between a light load state and a heavy load state. In the FIG. 3 example HLT bias controller 302, switch transistor M34 is a PMOS device. Therefore, HYS in the light load state is a high level, which switches the switch transistor M34 OFF, placing the two-state current mirror 350 in its light load state. Likewise, HYS in the heavy load state is a low level, which by operation of the switch transistor M34, switches the switched current mirror device 352 to an ON state. This places the two-state current mirror 350 in its heavy load state.

Referring to FIG. 3, in one aspect, the switched current mirror transistor M32 of the switched current mirror device 352 may be configured to have the same current-voltage characteristic as the current mirror transistor M30. Assuming a configuration according to this aspect, when the two-state current mirror 350 is in its heavy load, meaning the switched current mirror device 352 is ON, it functions as a doubling of the current mirror transistor M30, absent the limitation of I_SN to I_TH imposed by the threshold current source 306.

As previously described, the threshold current source 306 is coupled between the sense node 304 and Vss. In an aspect, the threshold current source 306 may be configured with a current-to-voltage characteristic that effectively sources, i.e., passes, I_SN from the sense node 304 to Vss without substantial resistance—provided I_SB is less than I_THX. Further to this aspect, the threshold current source 306 can be configured to provide substantial resistance to a magnitude of I_SN greater than I_THX.

An inverting threshold detector 308 has an input (shown but not separately numbered) coupled to the sense node 304, and an output coupled to the gate of the switch transistor M34. The output of the inverting threshold detector 308 is the above-described hysteresis control signal HYS that couples to the gate (shown but not separately numbered) of the switching transistor M34 of the switched current mirror device 352. A previously described, the inverting threshold detector 308 has a switching threshold corresponding to VTH of the threshold current source 306. In an aspect, the HLT bias controller 302 may include a bias signal generating circuit or function, for example a series arrangement of the inverting threshold detector 308 and another buffer, such as the inverting buffer 310 for generating ADP_BIAS based on the state of the two-state current mirror 305.

It will be understood from the description above that when the two-state current mirror 350 is in its light load state, I_SN is less than I_THX and the current mirror transistor M30 is the only device supplying I_SN. However, upon I_LOAD exceeding a given I_TH1, e.g., above-described THLD, the pass gate control voltage Vhg causes the current mirror transistor M30 to pass a current greater than I_THX. Upon I_SN exceeding I_THX the current-voltage characteristic of the threshold current source 306 rapidly increases Vdet at the sense node 304 to a value exceeding VTH. The corresponding switching of the inverting threshold detector 308 switches HYS to a low value. The switching of HYS to the low value switches ON the switched current mirror device 352. This places the two-state current mirror 350 in the heavy load state. As will be appreciated from further detailed description, a result of the switched current mirror device 352 being in an ON state is that I_LOAD must be smaller than THLD before I_SN can fall below I_THX, i.e., where Vdet will be less than the VTH. For example, assuming the switched current mirror transistor M32 of the switched current mirror device 352 has the same current-voltage characteristic as the current mirror transistor M30, I_LOAD must fall to less than ½ THLD before I_SN will fall below I_THX. This provides the hysteresis feature of the HLT bias controller 302.

As previously described, in an aspect, for I_SN less than I_THX the current mirror transistor M30 may be configured to generate I_SN in scalar proportion, e.g., 1/K, to I_LOAD. Techniques for configuring the current mirror transistor M30 to generate I_SN as 1/K of I_LOAD are described in greater detail at later sections. For example, if K is eight I_SN will be ⅛ of I_LOAD and, therefore, the threshold current source 306 must be configured such that I_THX is ⅛ of THLD. Continuing with this example, another assumption is that the switched current mirror transistor M32 of the switched current mirror device 352 has the same current-voltage characteristic as the current mirror transistor M30. Therefore, upon I_SN exceeding I_THX, the above-described rapid increase of Vdet will cause HYS to go low, which switches on the switched current mirror device 352. This places the two-state current mirror 350 in the heavy load state. Absent the cut-off imposed by the threshold current source 306, the two-state current mirror 350 generates I_SN as ¼ of I_LD, instead of ⅛ of I_LOAD. However, the cut-off or saturation of the threshold current source 306 is ⅛ of THLD. Therefore, I_SN will not fall below I_THX until I_LD falls below ½ THLD.

Figure 4:
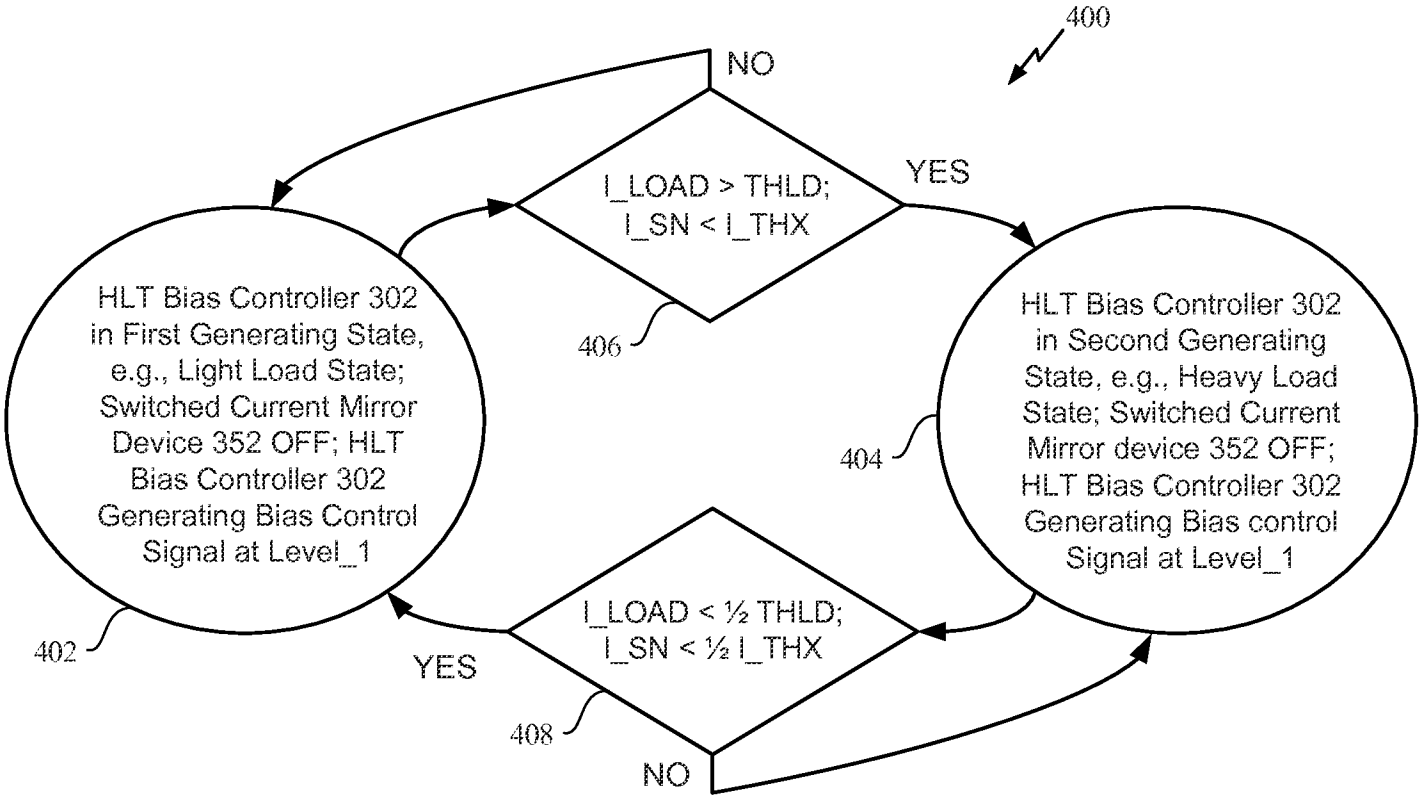
FIG. 4 shows one state transition flow according to one illustrative hysteresis rule, in practices of load-based biasing in accordance with one or more exemplary embodiments

Example operations of the HLT bias controller 302 in generating ADP_BIAS according to one illustrative hysteresis rule will be described in reference to FIG. 4. FIG. 4 shows one state transition flow 400 according to the illustrative hysteresis rule, in practices of load-based biasing in accordance with one or more exemplary embodiments. The example hysteresis rule corresponding to the state transition flow 400 includes a first generating state 402 and a second generating state 404. The first generating state 402 may be the above-described light load state, characterized by the switched current mirror device 352 being OFF. The second generating state 404 may be the above-described heavy load state, characterized by the switched current mirror device 352 being ON. The HLT bias controller 302 can generate the bias control signal ADP_BIAS (as well as ADP_CMP) according to its present generating state, which is one of the first generating state 402 and the second generating state 404. Upon a transition event that is defined according to HLT bias controller 302's present state, the HLT bias controller 302 transitions to a next generating state. In this example, the next generating state is the other of the first generating state 402 and the second generating state 404. The HLT bias controller 302 then makes the next generating state its present generating state, and generates the bias control signal according to that present generating state.

Referring to the FIG. 4 state transition flow 400, when the present generating state of the HLT bias controller 302 is the first generating state 402 (i.e., the light load state), the transition event is transition event 406, which is the load current I_LOAD exceeding a first threshold, e.g., THLD. When the present generating state of the HLT bias controller 302 is the second generating state 404 (i.e., the heavy load state), the transition event is transition event 408, which is the load current I_LOAD falling below exceeding a second threshold that is lower than the first threshold. One example second threshold can be the above-described ½ THLD.

Referring to FIG. 3, another example operation of the HLT bias controller 302 in an aspect of a hysteresis-rule of generating ADP_BIAS for a load-based biasing in accordance with one or more exemplary embodiments will be described. The example assumes the current mirror transistor M30 being configured to generate I_SN as a scalar, 1/K, of I_LOAD. The example assumes K to be eight and assumes the first threshold is the previously described THLD. The threshold current source 306 is therefore configured such that I_THX is ⅛ THLD. The example assumes the current mirror transistor M30 and the switched current mirror transistor M2 (when enabled by the switch transistor M34 being ON) have substantially the same voltage-current characteristics.

In one example operation, the two-state current mirror 350 may be assumed to start in the light load state, i.e., I_SN less than I_THX. Vdet at the sense node 304 is therefore less than VT and, accordingly, the HYS output of the inverting threshold detector 308 is high. The switched current mirror device 352 is therefore OFF and the inverting buffer 310 generates ADP_BIAS at Level__1. Generation of ADP_CMP is not described, but may be assumed to be at a level corresponding to ADP_BIAS at Level__1. The current mirror transistor M30 varies I_SN as 1/K times I_LOAD and, since I_LOAD is less than THLD, I_SN is less than I_THX. When I_LOAD reaches THLD. I_SN reaches I_THX, the sharp cut-off of the threshold current source 306 causes Vdet on the sense node 304 to quickly rise above VTH. In response, the inverting threshold detector 308 output i.e., the hysteresis control signal HYS, switches to a low or logical "0" state. This, in turn, has two effects. One is the ADP_BIAS output from the inverter 310, switches to Level__2, which switches the adaptive tail current source 206 OFF, or reducing I_BIAS to a lower default value. The second is that the switch transistor M34 of the switchable current mirror device 352 switches ON, effectively doubling the current versus Vhg characteristic of the two-state current mirror 350. I_SN therefore remains slightly above I_THX, which continues to hold Vdet above VTH.

Continuing with the above-described example, assume I_LOAD decreases to a level slightly below THLD. If the current mirror transistor M30 were the only current mirror responding to Vhg, the sense current I_SN would fall below I_THX. However, since the two-state current mirror 350 is in the heavy load state, the switch transistor M34 is ON and both the current mirror transistor M30 and the switched current mirror transistor M32 are operative. Therefore, I_SN will not fall below I_THX until I_LOAD is less than one-half of THLD. Assuming I_LOAD eventually decreases to slightly lower than one-half of THLD, the corresponding lowering of I_SN to less than I_THX causes Vdet to fall below VTH. The inverting threshold detector 308 will then switch HYS to a high state, which places the two-state current mirror 350 back to the light load state.

Example aspects of structure and arrangement of the transistors M30, M32 and M34 will now be described in greater detail.

In an aspect, M30 and M9 may have substantially the same structure except for M30 having a channel width (not explicitly shown) that is a fractional portion, for example, 1/K, of the M9 channel width (not explicitly shown). It will be understood by persons of skill in the art that K may be unity, but a result may be significant power loss in the HLT bias controller 302. As previously described, one example value of K is eight. For this value of K the channel width of M30 can be ⅛ the channel width of the pass gate M9. This is only an example, not intended to limit the scope of any exemplary embodiment.

In an aspect, the channel widths of M32 and M34 may be identical to the channel width of M30. As will be appreciated by persons skilled in the art upon reading this entire disclosure, this example relation of the channel widths of M30, M32 and M34 may provide I_TH2 as ½ I_TH1. As will also be appreciated, the proportional relationships of the channel widths of M30, M32 and M34 may be varied to provide correspondingly different proportional relationships of I_TH2 to I_TH1.

In an aspect, the threshold current source 306 may be configured without adjustability, i.e., I_THX may be fixed. In an aspect, the threshold current source 306 may be configured to provide adjustability of I_THX, for example, under control of a threshold current control line (not shown) extending from, for example, a control bus (not shown).

It will be appreciated that various exemplary embodiments can provide, among other features, dynamic adjustment of bias current and compensation component values to optimal values for specific sub-ranges of output current, rather than using one set of values over the entire range of output current values, for the purpose of improving output voltage droop and stability performance.

Figure 5:
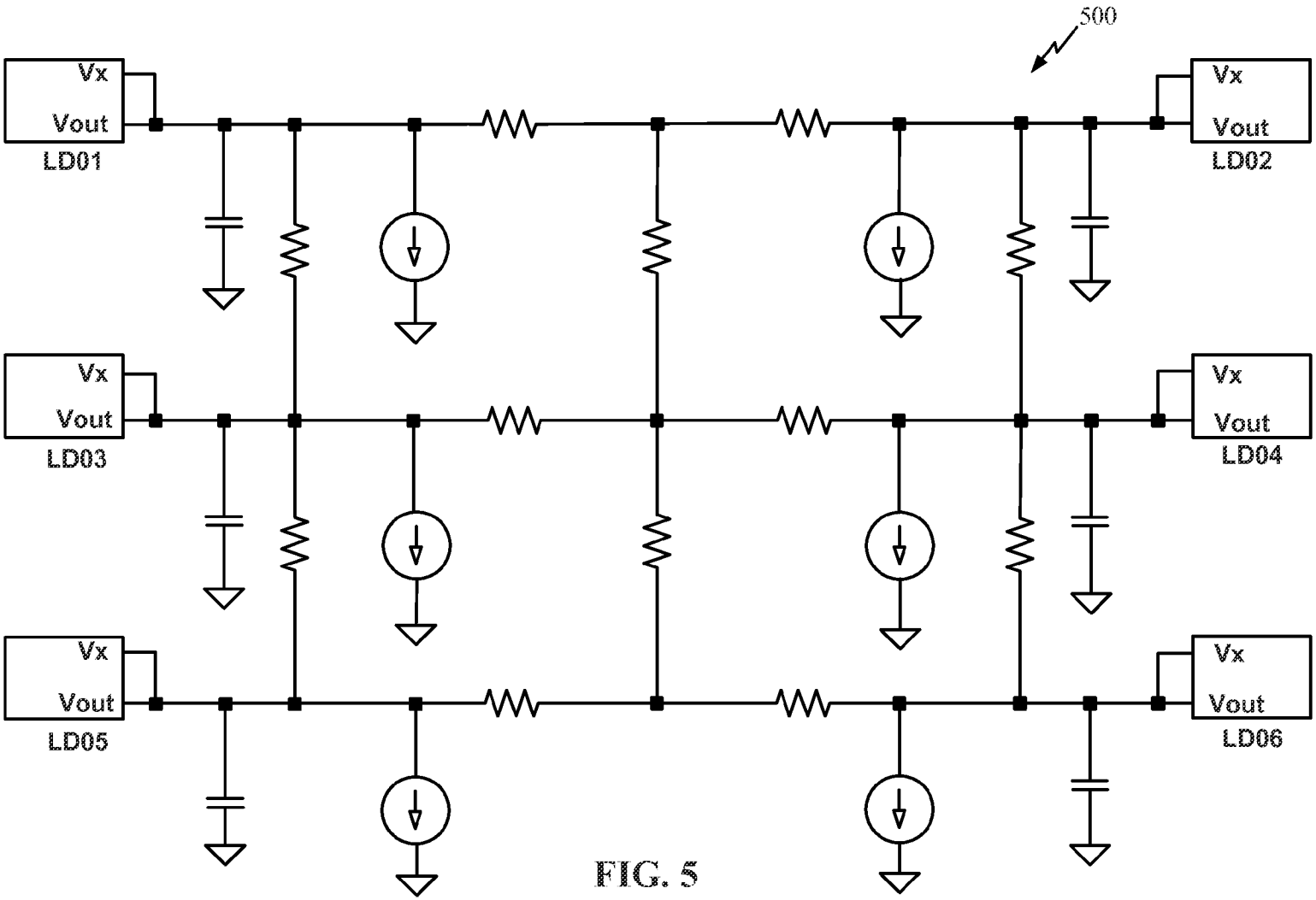
FIG. 5 shows one example topology of a power distribution network having a plurality adaptive bias and compensation LDO regulator units in accordance with one or more exemplary embodiments, connected in parallel, exemplary parasitic elements of the interconnecting power distribution network.

FIG. 5 shows a topology 500 with an example of six adaptive bias and compensation LDO regulators, illustrated with abbreviated labels LDO, LDO2 . . . LDO6, connected in parallel and showing parasitic elements (shown but not separately labeled) of the power distribution network that interconnects them. It may be assumed that each of adaptive bias and compensation LDO regulators LDO1, LDO2 . . . LDO6 is according to the FIG. 2 example adaptive bias and compensation LDO regulator 200. It may be assumed that each of the LOD regulators has a Vref input (not shown) and that each Vref input is connected to Vref source (not shown). In an aspect, at least one Vref source (not shown) may be shared by two or more of the adaptive bias and compensation LDO regulators LDO1, LDO2 . . . LDO6. It will be understood that the FIG. 5 capacitors (shown but not separately labeled) may represent explicitly placed load capacitances as well as parasitic capacitances.

Figure 6:
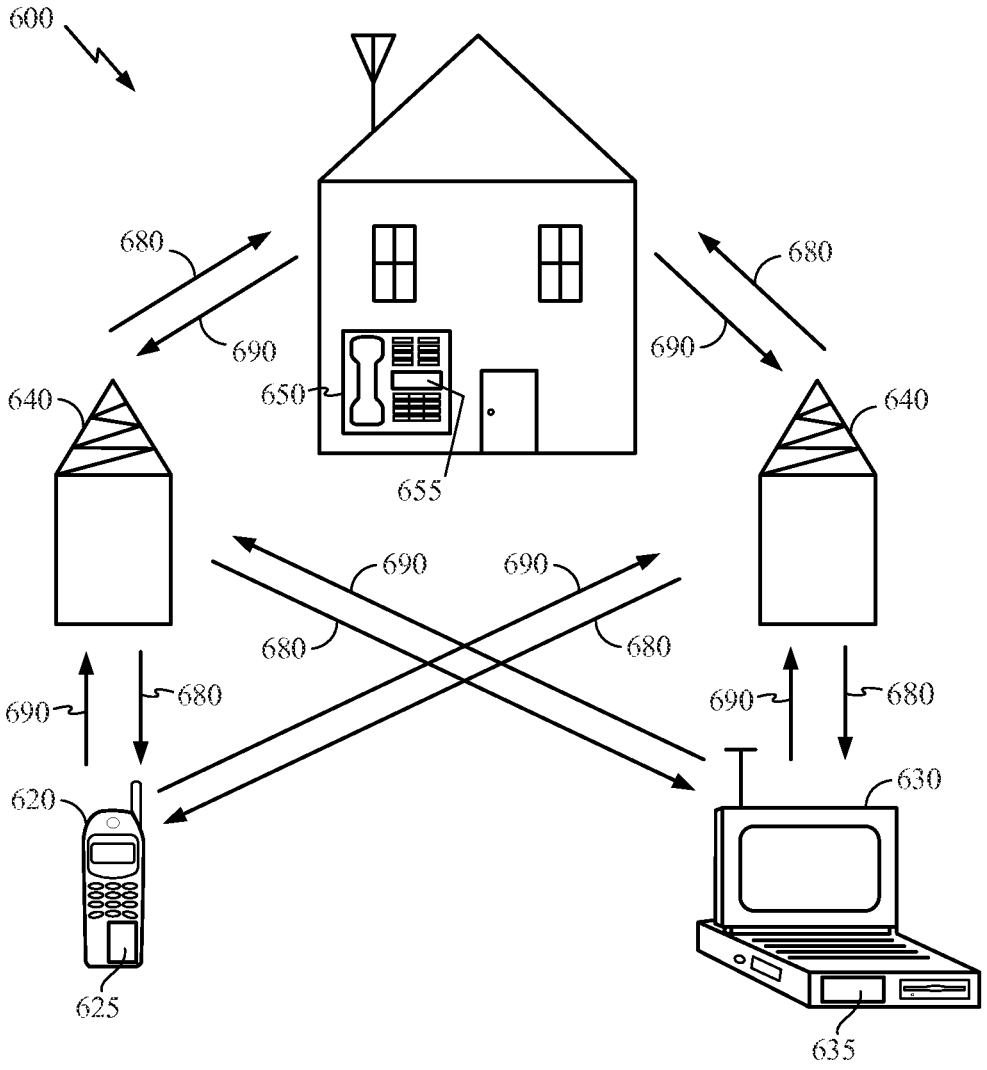
FIG. 6 shows one system diagram of one wireless communication system having, supporting, integrating and/or employing adaptive bias and compensation LDO units in accordance with one or more exemplary embodiments.

FIG. 6 illustrates an exemplary wireless communication system 600 in which one or more embodiments of the disclosure may be advantageously employed. For purposes of illustration, FIG. 6 shows three remote units 620, 630, and 650 and two base stations 640. It will be recognized that conventional wireless communication systems may have many more remote units and base stations. The remote units 620, 630, and 650 include integrated circuit or other semiconductor devices 625, 635 and 655 (including on-chip voltage regulators, as disclosed herein), which are among embodiments of the disclosure as discussed further below. FIG. 6 shows forward link signals 680 from the base stations 640 and the remote units 620, 630, and 650 and reverse link signals 690 from the remote units 620, 630, and 650 to the base stations 640.

In FIG. 6, the remote unit 620 is shown as a mobile telephone, the remote unit 630 is shown as a portable computer, and the remote unit 650 is shown as a fixed location remote unit in a wireless local loop system. For example, the remote units may be any one or combination of a mobile phone, hand-held personal communication system (PCS) unit, portable data unit such as a personal data assistant (PDA), navigation device (such as GPS enabled devices), set top box, music player, video player, entertainment unit, fixed location data unit such as meter reading equipment, or any other device that stores or retrieves data or computer instructions, or any combination thereof. Although FIG. 6 illustrates remote units according to the teachings of the disclosure, the disclosure is not limited to these exemplary illustrated units. Embodiments of the disclosure may be suitably employed in any device having active integrated circuitry including memory and on-chip circuitry for test and characterization.

The foregoing disclosed devices (such as the devices of FIG. 2, 3 or 4 or any combination thereof) may be designed and configured into computer files (e.g., RTL, GDSII, GERBER, etc.) stored on computer readable media. Some or all such files may be provided to fabrication handlers who fabricate devices based on such files. Resulting products include semiconductor wafers that are then cut into semiconductor die and packaged into a semiconductor chip. The semiconductor chips can be employed in electronic devices, such as described hereinabove.

The methods, sequences and/or algorithms described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor.

Accordingly, an embodiment of the invention can include a computer readable media embodying a method for implementation. Accordingly, the invention is not limited to illustrated examples and any means for performing the functionality described herein are included in embodiments of the invention.

The foregoing disclosed devices and functionalities may be designed and configured into computer files (e.g., RTL, GDSII. GERBER, etc.) stored on computer readable media. Some or all such files may be provided to fabrication handlers who fabricate devices based on such files. Resulting products include semiconductor wafers that are then cut into semiconductor die and packaged into a semiconductor chip. The chips are then employed in devices described above.

While the foregoing disclosure shows illustrative embodiments of the invention, it should be noted that various changes and modifications could be made herein without departing from the scope of the invention as defined by the appended claims. The functions, steps and/or actions of the method claims in accordance with the embodiments of the invention described herein need not be performed in any particular order. Furthermore, although elements of the invention may be described or claimed in the singular, the plural is contemplated unless limitation to the singular is explicitly stated.

What is claimed is:

1. An adaptive low dropout (LDO) regulator comprising:

a pass gate, having a pass gate output and having a control input for receiving a pass gate control signal, wherein the pass gate is configured to provide, for a load current, a variable resistance current path from an external power rail to the pass gate output, at a resistance based, at least in part, on the pass gate control signal, and to output the load current from the pass gate output;

a load-based bias controller circuit, configured to generate a load-based bias control signal at a value that corresponds to the load current, wherein the load-based bias control signal switches from a first bias control level to a second bias control level in response to the load current increasing past a threshold and switches from the second bias control level to the first bias control level in response to the load current decreasing from a level that is above the threshold to a level that is less than the threshold;

an adaptive bias differential amplifier, having a first input, a second input and a transistor, wherein the first input is coupled to the pass gate output, and the transistor has a gate coupled to the first input or to the second input, wherein the adaptive bias differential amplifier is configured to receive the load-based bias control signal with a bias current, the bias current being, in response to the first bias control level of the load-based bias control signal, a light load bias current and, in response to the second bias control level of the load-based bias control signal, being a heavy load bias current, wherein the light load bias current is higher than the heavy load bias current, and wherein the adaptive bias differential amplifier is further configured to generate the pass gate control signal based on voltages received on the first input and the second input.

2. The adaptive LDO regulator of claim 1, wherein the adaptive bias differential amplifier further includes an adaptive tail current source, wherein the adaptive tail current source is configured to receive the load-based bias control signal and, in response to the first bias control level, to pass the light load bias current through the transistor and, in response to the second bias control level, to pass the heavy load bias current through the transistor.

3. The adaptive LDO regulator of claim 1, wherein the load-based bias controller circuit is further configured to generate a load-based compensation control signal, and to generate the load-based compensation control signal based, at least in part, on the load current, wherein the adaptive LDO regulator further comprises:

an adaptive compensation network, wherein the adaptive compensation network is coupled between the pass gate output and the adaptive bias differential amplifier, wherein the adaptive compensation network is configured to provide at least one zero in a transfer characteristic, wherein the adaptive compensation network includes a variable capacitance element, wherein the variable capacitance element is coupled to the load-based compensation control signal, wherein the variable capacitance element has capacitance value that changes in response to changes in the load-based compensation control signal, and wherein the adaptive compensation network is further configured to adjust a position of the at least one zero in response to the changes in the capacitance value.

4. The adaptive LDO regulator of claim 1, wherein the adaptive bias differential amplifier further includes an adaptive tail current source, wherein the adaptive tail current source is configured to receive the load-based bias control signal, wherein the transistor has a first electrode, wherein the first electrode is coupled by a first current source transistor to the external power rail, and has a second electrode and wherein the adaptive tail current source is coupled to the second electrode of the transistor, and is configured to pass the bias current through the transistor.

5. The adaptive LDO regulator of claim 1, wherein the threshold is a load threshold, and wherein the load-based bias controller circuit is further configured to generate the load-based bias control signal at the second bias control level in response to the load current exceeding the load threshold, and to generate the load-based bias control signal at the first bias control level in response to the load current not exceeding the load threshold.

6. The adaptive LDO regulator of claim 1, wherein the load-based bias controller circuit comprises:

a load current detector circuit, wherein the load current detector circuit is configured to detect a magnitude of the load current and to generate, in response, a load detection signal; and at least one comparator, wherein the at least one comparator is configured to receive the load detection signal, compare the load detection signal to at least one reference, and generate, in response, the load-based bias control signal.

7. The adaptive LDO regulator of claim 6, wherein the at least one comparator configured is further configured to generate the load-based bias control signal at the second bias control level in response to the load detection signal exceeding a load detection threshold, and to generate the load-based bias control signal at the first bias control level in response to the load detection signal not exceeding the load detection threshold.

8. The adaptive LDO regulator of claim 7, wherein the load current detector circuit is coupled to the pass gate control signal and is configured to detect the load current based, at least in part, on the pass gate control signal.

9. A method for controlling a low dropout (LDO) regulator having a voltage-controlled pass gate that includes a pass gate output and having a transistor-based differential amplifier that is configured to control the voltage-controlled pass gate to pass a load current from a power rail to the pass gate output, comprising:

generating a bias control signal, wherein the bias control signal is indicative of a characteristic of the load current, wherein generating the bias control signal switches a value of the bias control signal from a first bias control level to a second bias control level in response to the load current increasing past a threshold level, and switches the value of the bias control signal from the second bias control level to the first bias control level in response to the load current decreasing from a level above the threshold level to a level less than the threshold level; and biasing the transistor-based differential amplifier with a load bias current, wherein the load bias current is according to the bias control signal, wherein, in response to the first bias control level, the load bias current is a light load bias current and, in response to the second bias control level, the load bias current is a heavy load bias current, and wherein the light load bias current level is higher than the heavy load bias current.

10. The method of claim 9, wherein the threshold level is a load threshold, and wherein generating the bias control signal comprises generating the bias control signal at the first bias control level in response to the load current exceeding the load threshold, and generating the bias control signal at the second bias control level in response to the load current not exceeding the load threshold.

11. The method of claim 9, wherein controlling the voltage-controlled pass gate is according to a transfer characteristic, wherein the transfer characteristic has a dominant pole and at least one zero, and wherein the method further comprises adjusting, in response to the load current, a position of at least one zero in the transfer characteristic.

12. A low dropout (LDO) regulator comprising:

a pass gate, configured to receive pass gate control signal, and configured to provide, for a load current, a variable resistance current path from an external power rail to a pass gate output, at a resistance based, at least in part, on the pass gate control signal, and to output the load current from the pass gate output;

a differential amplifier having a first input, a second input, and a transistor, wherein the first input is coupled to the pass gate output, wherein the transistor has a gate coupled to the first input or to the second input, wherein the differential amplifier is configured to generate the pass gate control signal based on voltages received on the first input and the second input; and means for adapting a bias of the transistor according to the load current, wherein said means comprises means for generating a bias control signal, wherein the means for generating the bias control signal is configured to switch a value of the bias control signal, in response to the load current increasing past a threshold level, from a first bias control level to a second bias control level and, in response to the load current decreasing from a level above the threshold level to a level less than the threshold level, to switch the value of the bias control signal from the second bias control level to the first bias control level, and means for biasing the transistor with a load bias current, wherein the load bias current is according to the bias control signal, wherein, in response to the first bias control level, the load bias current has a light load bias current and, in response to the second bias control level, the load bias current has a heavy load bias current, and wherein the light load bias current is higher than the heavy load bias current.

13. The LDO regulator of claim 12, wherein the threshold level is a load threshold, and wherein the means for adapting the bias of the transistor is configured to bias the transistor at the first bias control level in response to the load current exceeding the load threshold, and to bias the transistor at the second bias control level in response to the load current not exceeding the load threshold.

14. A method for controlling a low dropout (LDO) regulator having a pass gate output and having a transistor-based differential amplifier that is configured to control a voltage-controlled pass gate to pass a load current from a power rail to the pass gate output, comprising:

generating a bias control signal indicative of a magnitude of the load current; and biasing the transistor-based differential amplifier with a load bias current, wherein the load bias current is at a level according to the bias control signal, wherein the bias control signal is generated at stepped values, and wherein the stepped values include:

a first bias control level in response to the load current not exceeding a first current threshold, a second bias control level in response to the load current exceeding the first current threshold concurrent with not exceeding a second current threshold that is greater than the first current threshold, and a third bias control level in response to the load current exceeding the second current threshold.

* * * * *